United States Patent [19]

Nagati

[11] 4,284,266

[45] Aug. 18, 1981

[54] METALLURGICAL VESSEL CAPABLE OF RECEIVING FLUIDS IN SEPARATE FLOW PATHS WHILE PIVOTING

[75] Inventor: Rashed N. Nagati, Mars, Pa.

[73] Assignee: Pennsylvania Engineering Corporation, Pittsburgh, Pa.

[21] Appl. No.: 131,255

[22] Filed: Mar. 17, 1980

[51] Int. Cl.[3] ..... C21C 5/50

[52] U.S. Cl. ..... 266/246

[58] Field of Search ..... 266/246, 245, 247, 248

[56] References Cited

U.S. PATENT DOCUMENTS

| | | | |
|---|---|---|---|
| 3,146,983 | 9/1964 | Johnson | 266/246 |
| 3,653,648 | 4/1972 | Mevissen | 266/246 |
| 3,756,583 | 9/1973 | Nagati | 266/246 |
| 4,198,230 | 4/1980 | Brotzmann | 75/60 |

*Primary Examiner*—P. D. Rosenberg
*Attorney, Agent, or Firm*—Fred Wiviott

[57] ABSTRACT

A metallurgical vessel includes first and second tuyeres for respectively delivering process materials above and below the level of molten metal contained within the vessel. Coupled to one of the trunnion pins which support the vessel for pivotal movement about a horizontal axis is a rotary joint which defines a plurality of concentric flow paths for transporting cooling liquid to the vessel and process fluids to the first and second tuyeres. The passages are provided by a first plurality of coaxially spaced apart annular fixed members and a second plurality coaxially spaced apart annular members mounted on the trunnion pin and rotatable therewith. At least some of the plurality of members have portions which define lateral flow paths interconnecting one of the concentric flow paths. One of a plurality of first pipes are connected to each of the lateral flow paths defined by the first members and to sources of cooling liquids and process materials respectively and each of a second plurality of pipes are coupled to one of the second plurality of lateral flow passages defined by the second members and to the vessel support or to the first or second tuyeres.

12 Claims, 5 Drawing Figures

METALLURGICAL VESSEL CAPABLE OF RECEIVING FLUIDS IN SEPARATE FLOW PATHS WHILE PIVOTING

BACKGROUND OF THE INVENTION

This invention relates to metallurgical vessels and more particularly to a vessel adapted to be tilted and having a rotary joint for transporting process and cooling fluids from fixed sources to the vessel.

One type of metallurgical vessel for converting pig iron to steel, called a Q-BOP, includes one or more two-pipe tuyeres which extend through the refractory lining in the lower end of the vessel for delivering oxygen to molten metal contained therein. In order to prevent the rapid deterioration of the tuyere and the surrounding refractory, a hydrocarbon fluid such as propane, natural gas or light oil is injected through the gap between the inner and outer concentric tuyere pipes to provide a protective sheath in surrounding relation to the oxygen stream. In addition, such bottom tuyeres can be used for preheating the furnace charge which may contain solid material, such as scrap metal. When the tuyeres are used for normal oxygen blowing, the ratio of hydrocarbon to oxygen is relatively small and, accordingly, the gap between the inner and outer tuyere pipes is correspondingly small in relation to the area of the center pipe through which the oxygen is delivered. This limits the volume of fuel that can be delivered during preheating. As a result, a heavier hydrocarbon, such as oil, is used as a preheating fuel even though gas may normally be employed during the main oxygen blow. Because of different flow characteristics and the danger of accidental mixing, separate flow paths to the vessel are required for oxygen, oil, cooling water and hydrocarbon gas. It will also be appreciated that because the vessel pivots, it is necessary to deliver these fluids from fixed to rotary piping. Normally, cooling water and hydrocarbon fluids are delivered in separate flow paths through a first trunnion pin and oxygen is delivered through the other pin to prevent the accidental mixing of oxygen with any of the process fluids.

In addition to bottom tuyeres, Q-BOP vessels may also include concentric two-pipe top tuyeres both for preheating and for use during the metallurgical conversion process. As a result, an additional flow path is required through the first trunnion pin. One prior art system for delivering a plurality of fluids through one trunnion pin of a Q-BOP vessel is disclosed in U.S. Pat. No. 3,893,658. In this apparatus, concentric pipes extend through the trunnion pin for delivering cooling liquid and process fluids to the vessel. A rotary joint is coupled to the concentric pipes to permit the transfer of fluid from fixed sources to the pivoting vessel. Such prior art systems are not wholly satisfactory, however, because only a limited number of concentric pipes could be used in the limited space available in the trunnion pin.

SUMMARY OF THE INVENTION

It is the primary object of the invention to provide new and improved means for delivering cooling and process fluids in separate flow paths to a pivoting metallurgical vessel.

A more specific object of the invention is to provide a metallurgical vessel in which a plurality of separate fluid flow paths are provided through a single trunnion pin.

Yet another object of the invention is to provide a Q-BOP vessel in which separate flow paths are provided through a trunnion pin for hydrocarbon shielding fluids to upper and lower tuyeres, a heavier hydrocarbon fluid for preheating and for delivering and receiving cooling liquid from the vessel.

These and other objects and advantages of the invention will become more apparent from the detailed description thereof taken with the accompanying drawings.

In general terms, the invention comprises a refractory lined metallurgical vessel having a trunnion support and a plurality of trunnion pins extending from the support for being rotated to tilt the vessel about a generally horizontal axis. A plurality of tuyeres extending through the lining of the vessel and each includes a pair of concentric spaced apart pipes for simultaneously providing plural fluids to said vessel. The invention is characterized by a rotary joint including first and second portions. The first portion of said rotary joint, according to the invention, includes a first plurality of concentric, generally annular members spaced apart radially from each other and affixed to one of said trunnion pins for rotation therewith, and defining a first plurality of axially extending and radially spaced apart flow passages. The second portion of the rotary joint includes a second plurality of concentric, generally annular members which are spaced apart radially from each other and coradial with corresponding ones of the first plurality of members to define a second plurality of axially extending and concentric flow passages which have the same radial displacement as corresponding ones of said first plurality of flow passages. The first and second rotary joint portions are disposed in an abutting relation whereby at least some of the first plurality of flow passages communicate with corresponding ones of the second plurality of flow passages. A first and a second plurality of passageway means formed respectively in the first and second portions of the rotary joint and extend at an angle relative to the axis of rotation. Each of the first plurality of passageway means are connected to a different one of the passages of the first plurality of flow passages. Each of the first plurality of pipe means are connected to a different one of the first passageway means and converge toward the axis of rotation of one trunnion pin and pass through the axial opening therein. Each of the second plurality of passageway means are connected to a different one of the flow passages of the second plurality of flow passages. Each of the pipes of a second plurality of pipes are connected to a different passageway means of the second plurality of passageway means, whereby each of the second plurality of passageways may be connected to a different source of process fluid for said vessel.

DETAILED DESCRIPTION OF THE PREFERRED EMBODIMENTS

Figure 1:
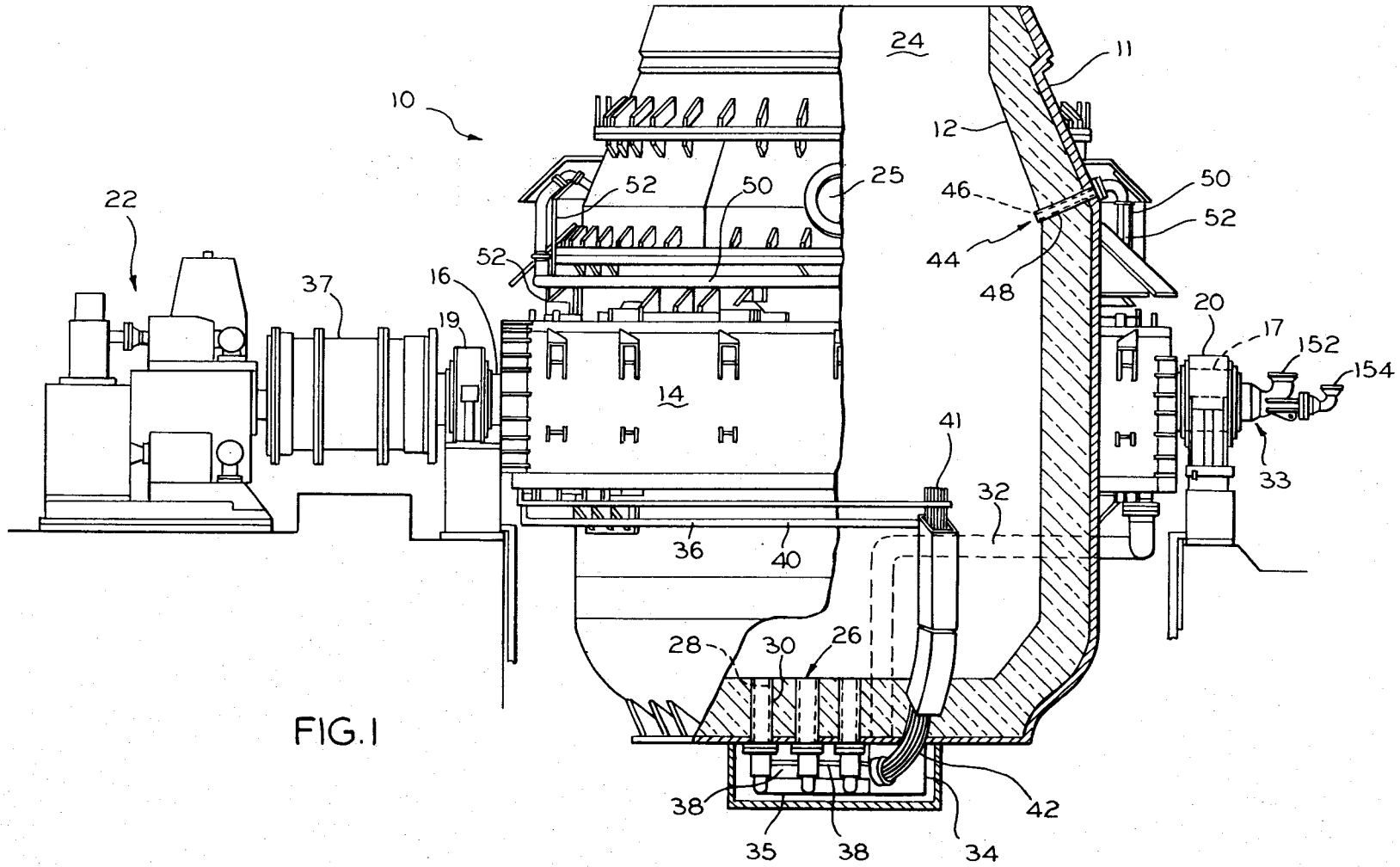
FIG. 1 is a cite elevational view of the metallurgical vessel according to the present invention.

FIG. 1 shows a metallurgical vessel 10 with which the rotary joint of the present invention may be employed. The vessel 10 is generally pear shaped and includes a metallic shell 11 and a refractory lining 12. Support for the vessel 10 is provided by a trunnion ring 14 having trunnion pins 16 and 17 extending from diametrically opposite sides. The trunnion ring 17 may be hollow for being cooled by water to be supplied in a manner to be described below. Trunnion pins 16 and 14 are respectively supported for pivotal movement about a generally horizontal axis by suitable bearings 19 and 20. A conventional drive assembly 22 is coupled to trunnion pin 16 for tilting the vessel to permit the charging of hot metal and/or scrap through the vessel's open upper end 24 or for discharging metal from pouring spout 25 which opens into one side of the vessel and between the trunnion ring 14 and the upper end 24.

A first plurality of tuyeres 26 extend vertically through the refractory 12 at the lower end of the vessel 10. The details of the tuyeres 26 are not shown in detail but are the type well known for use in the Q-BOP process. In particular, tuyeres 26 include concentric spaced apart pipes 28 and 30 wherein the center pipe 28 defines a first flow path and the gap between the pipes 28 and 30 defines a second flow path. As those skilled in the art will appreciate, oxygen is delivered through the center pipe 28 during the main oxygen blow for oxidizing carbon and other substances with the metallic charge whereby pig iron may be converted to steel. In order to minimize erosion of the tuyeres 26 and the surrounding refractory 11, a hydrocarbon fluid, such as propane, natural gas, or light oil, is injected in a surrounding relation to the oxygen through the gap between the inner pipe 28 and the outer pipe 30. Because the volume of hydrocarbon shielding fluid is relatively small in comparison to the oxygen being delivered, the gap between the inner and outer pipes is relatively small in an area when compared to that of the center pipe 28.

Oxygen to the center tuyere pipe 28 is delivered by a conduit 32 which is connected at its upper end to a first rotary joint 33 affixed to trunnion pin 17. From rotary joint 33, pipe 32 extends downwardly and then horizontally around one side of the vessel 10 and downwardly where its lower end is connected to a distributor 34 mounted on the vessel's lower end. From distributor 34, oxygen is conducted to each of the center pipes 28 by means of individual conduits 35.

Hydrocarbon shielding fluid is delivered to the gap between tuyere pipes 28 and 30 by means of a conduit 36 connected at one end to a second rotary joint 37 which is mounted on the drive side trunnion pin 16. Pipe 36 extends downwardly from trunnion pin 16, around the near side of the vessel as viewed in FIG. 1 and downwardly to the vessel bottom where it is connected to tuyeres 26 by individual feed pipes 38. Similarly, preheating oil may alternately be provided to the gap between tuyere pipes 28 and 30 by a second pipe 40 which extends in parallelism with pipe 36 and between the trunnion pin 16 and a distributor 41. A plurality of small feeder pipes 42 extend downwardly from the distributor 36 where their lower ends are connected to the individual pipes 38 by valves (not shown) which are responsive to pressure to couple either to the gas pipe 36 or the feeder pipes 42 depending upon which is pressurized.

Also extending through the vessel lining 10 and above the expected level of molten metal therein are a second plurality of tuyeres 44 each of which also includes an inner pipe 46 and a second concentric spaced apart outer pipe 48. The inner pipes 46 of each tuyere 44 are coupled to receive oxygen from the rotary joint 33 by a conduit 50 which extends upwardly therefrom and circumferentially around the near side of the vessel as viewed in FIG. 1. In addition, conduits 52 extend upwardly from trunnion pin 16 and in parallelism with conduit 50 for connecting the gap between pipes 46 and 48 to rotary joint 37 for conducting hydrocarbon gas thereto.

Figure 2:
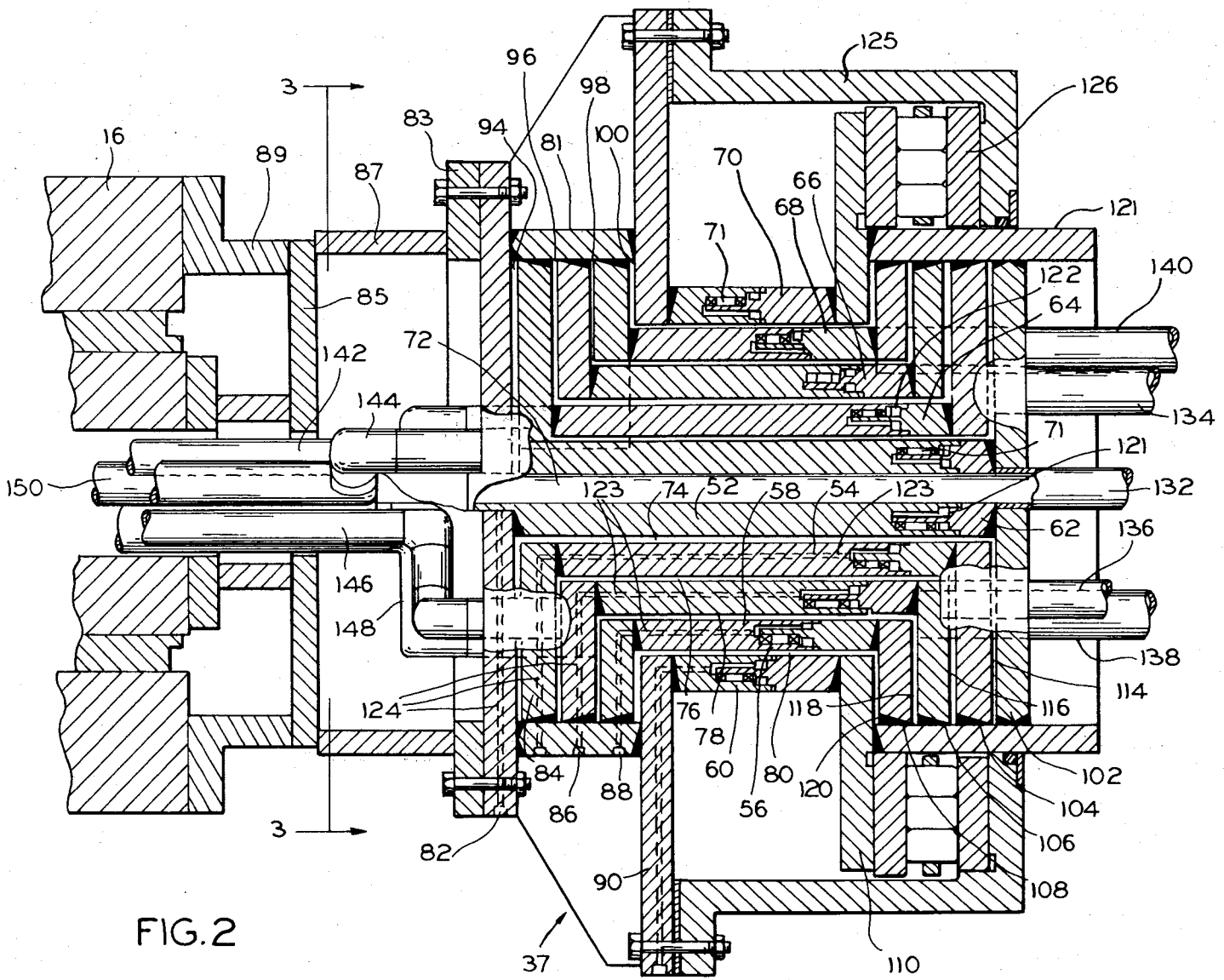
FIG. 2 is an enlarged sectional view of the rotary joint portion of the vessel illustrated in FIG. 1.
Figure 3:
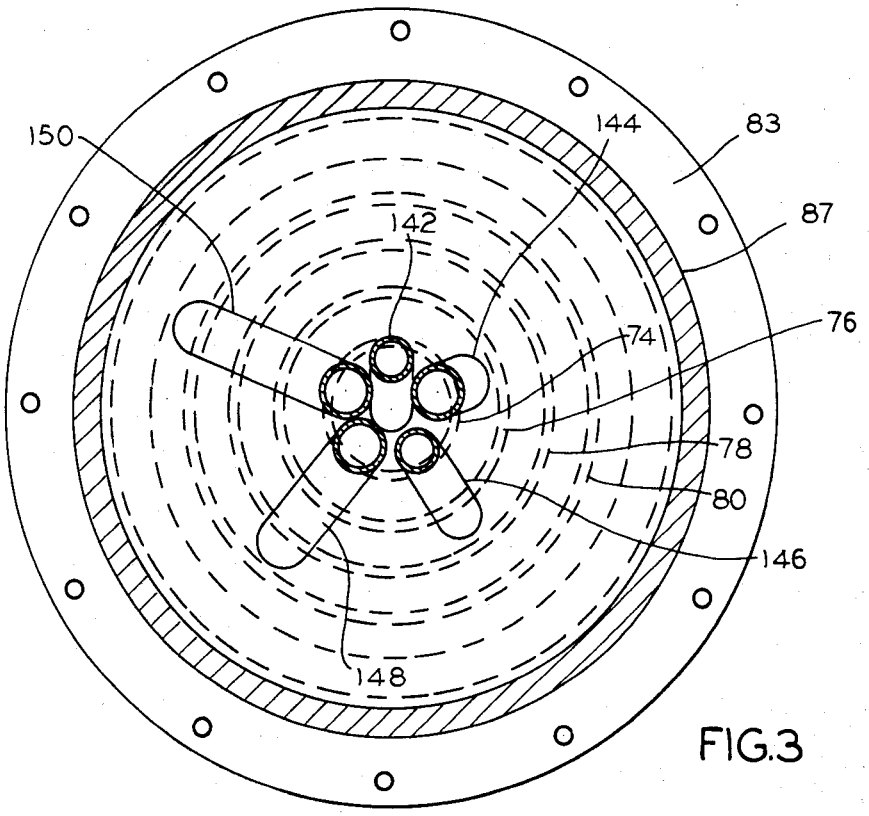
FIG. 3 is a view taken along lines 3, 3 of FIG. 2.

The second rotary joint 37 is shown more particularly in FIGS. 2 and 3 to include a first plurality of concentric spaced apart tubular members 52, 54, 56, 58 and 60 which are affixed to and rotatable with trunnion pin 16. In addition, there are a second plurality of concentric, spaced apart tubular members 62, 64, 66, 68 and 70 which are co-radial and are disposed in endwise engagement with the members 52, 54, 56, 58 and 60, respectively. Roller bearings 71 are disposed between the mating ends of members 52–60 and 62–70, respectively, to permit relative rotational movement therebetween. The endwise engagement between the fixed and rotatable members and the radial spacing between adjacent member pairs defines a first flow passage 72 within the interior of members 52–62; a second flow passage 74 in the gap between member pairs 52–62 and 54–64; and third flow passage 76 in the gap between member pairs 54–64 and 56–66; a fourth flow passage 78 in the gap between member pairs 56–66 and 58–68; and a fifth flow passage 80 in the gap between the member pairs 58–68 and 60–70.

Each of the members 52, 54, 56, 58 and 60 have radial flanges 82, 84, 86, 88 and 90, respectively, affixed to their ends opposite the members 62–70 and each is spaced from the flange of the adjacent member. In addition, an annular member 81 is affixed between the relatively longer end flanges 80 and 90 and to the ends of the relatively shorter intermediate flanges 84, 86 and 88. The flanges 82–90 and member 81 are suitably joined, such as by welding to provide a relatively rigid assembly which is affixed to the trunnion ring 16 by members 83, 85, 87 and 89. This structure defines a plurality of radial passages 94, 96, 98 and 100 in the gaps between adjacent flange pairs and said radial passages 94, 96, 98 and 100, respectively, communicate with passages 74, 76, 78 and 80.

Also affixed to the opposite ends of the fixed members 62, 64, 66, 68 and 70 are radial flanges 102, 104, 106, 108 and 110, which are each also spaced from the adjacent flanges to define radial passages 114, 116, 118 and 120 therebetween. The passages 114, 116, 118 and 120, respectively, communicate with passages 74, 76, 78 and 80. An annular member 121 is affixed to the peripheries of flanges 102–110 for closing the ends of radial passages 114–120. Means, not shown, are connected to member 121 to restrain the same against rotation.

It will be appreciated from the foregoing description that the rotary joint 37 defines a first plurality of radial flow passages 94, 96, 98 and 100 which rotate with the trunnion pin 16 and a second plurality of radial flow passages 114, 116, 118 and 120 which are fixed. In addition, there are a plurality of concentric, axially extending passages 74, 76, 78 and 80 which respectively connect radial passages 94, 96, 98 and 100 to 114, 116, 118 and 120. In addition, passage 72 extends centrally along the rotational axis. In this manner, all of the axial flow passages are defined by structure which rotates at the trunnion pin and which are fixed at the opposite end.

Those skilled in the art will appreciate that suitable sealing means 122 will be provided between the mating ends of rotating members 52–60 and fixed members 62–70 to seal the passages 72–80 at the relatively rotating connection. In addition, an axial passage 123 is formed in each member 52–60 from the bearing 71 to its radial flange and a radial passage 124 is formed in each of the radial flanges 82–92 to provide an atmospheric vent at the point of most probable leakage around seals 122. An annular housing 125 is affixed at one end to the flange 90 and a bearing 126 is provided at its other end for rotatably engaging the fixed annular member 121.

Pipes 132, 134, 136, 138 and 140 extend respectively through openings in flanges 102, 104, 106, 108 and 110 for connection to central passage 72 and to radial passages 114, 116, 118 and 120. Similarly, pipes 142, 144, 146, 148 and 150 connect respectively center passage 52 and radial passages 94, 96, 98 and 100 to the vessel 10. More specifically, pipe 140, for example, extends through aligned openings in flanges 102, 104, 106 and 108 with its inner end intersecting radial passage 120. At the rotatable end of rotary joint 37, pipe 150 extends through aligned openings in flanges 82, 84, 86 and 88 for intersection with the radial passage 100. In this manner, a continuous flow path is provided through the rotary joint from pipe 140 to pipe 150 and through the radial passages 100 and 120 and the axially extending passage 80. Each of pipes 134, 136, 138, 144, 146 and 148 are similarly connected to their associate radial passages. Also, pipes 132 and 142 are received in axial openings in flanges 102 and 82, respectively, for connection to the central passage 52. The openings in the flange 82–90 and 102–110 through which each of the pipes 132–150 pass are suitably sealed to said pipes so as to prevent leakage between adjacent radial passages.

The rotary joint 33, shown in FIG. 1, forms no part of the present invention and will not be discussed in detail for the sake of brevity. It will be sufficient for purposes of understanding the invention to state that the rotary joint 33, respectively, connects stationary pipes 152 and 154 to pipes 32 and 50 which pivot with the vessel 10. For a more specific description of the rotary joint 33, reference is made to U.S. Pat. No. 3,893,658 and particularly to FIG. 4 thereof.

The pipes 132–140 may be connected to any fluid sources depending upon the process to be performed. The vessel 10, according to the preferred embodiment of the invention, is particularly adopted to be used in a process wherein the initial charge includes scrap. As a result, the tuyeres 26 and 44 are used to preheat the scrap. After the scrap has been fluidized, oxygen may be delivered through the inner tuyere pipes 28 and 46 and a hydrocarbon shielding fluid may be delivered through the gap between the inner and outer pipes of tuyeres 26 and 44. Other process material such as argon, nitrogen, lime, carbon, air and iron oxide may be delivered to the vessel for performing various Q-BOP processes as are well known in the art. In addition, the trunnion ring 14 and the other portions of vessel 10 may be water-cooled which requires that cooling water be delivered to and withdrawn from the vessel 10. Because of the process and cooling requirements, pipe 132 may be connected to a source of oil for use during preheating; pipe 142 may be connected to pipe 140 which in turn is connected to the gap between the pipes of the lower tuyeres 26 by pipes 40 and 42; pipe 132 may be connected to a source of gas, such as propane or natural gas, and pipe 144 is connected by pipe 36 to the gap between the pipes of the lower tuyere 26; and pipe 136 may also be connected to a source of hydrocarbon gas and pipe 146 is connected to pipe 52 which in turn is connected to the gap between pipes 46 and 48 of upper tuyeres 44. Additionally, pipes 138 and 140 may be connected to a source of cooling water for conducting the same to and from the vessel 10 and pipes 148 and 150 may be coupled to trunnion ring 14 for conducting cooling water thereto and heating water therefrom.

Figure 5:
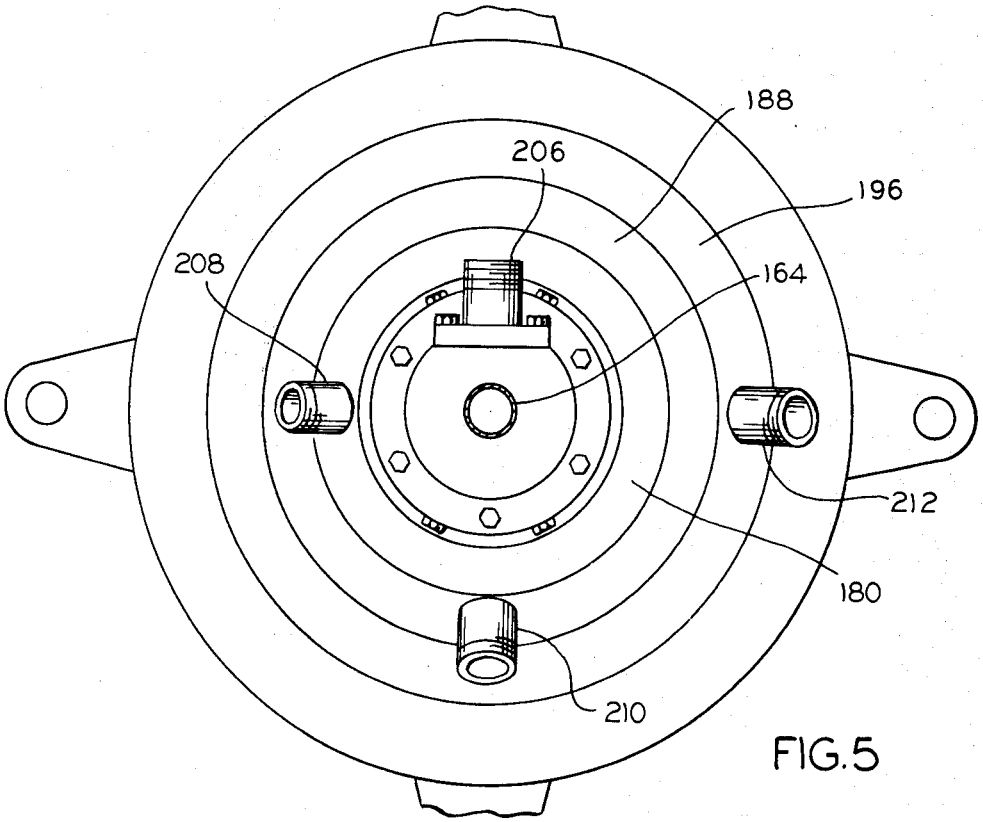
FIG. 5 is a view taken along lines 5, 5 of FIG. 4.
Figure 4:
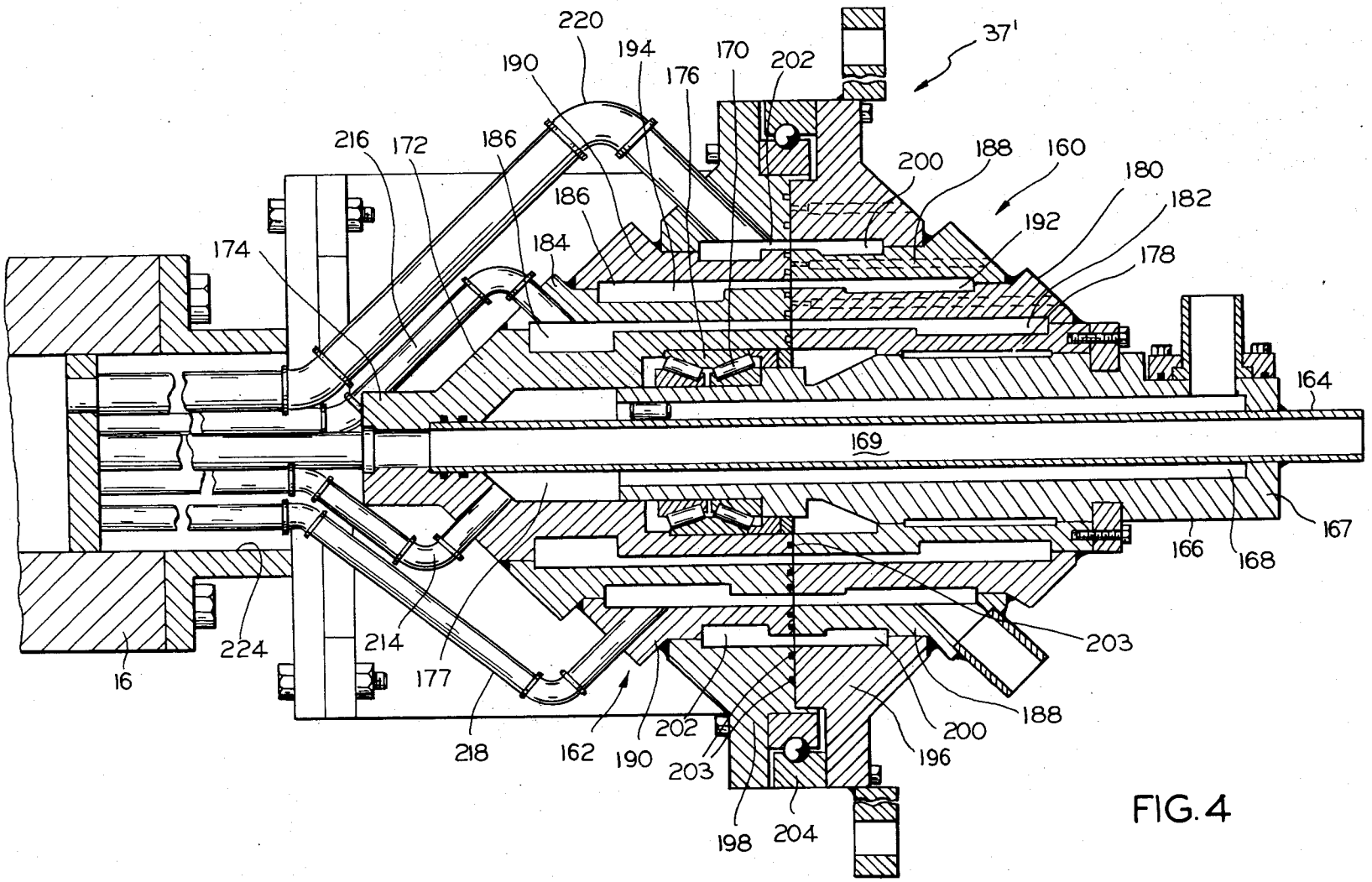
FIG. 4 is a side elevational view of an alternate embodiment of the rotary joint usable with the vessel of FIG. 1.

FIGS. 4 and 5 show an alternate embodiment of a rotary joint 37' to include a stationary body 160 coupled to fixed fluid sources and a rotary body 162 mounted on the trunnion pin 16. The bodies 160 and 162 each define a plurality of spaced apart axial cavities and interface in a relatively rotational sealing relation to provide series of continuous, axially extending, spaced apart, and co-axial passages.

More specifically, body 162 includes an axially extending central pipe 164 and a first sleeve 166 spaced from and co-axial with pipe 164 and having an inwardly extending flange 167 which is secured to pipe 164 adjacent its outer end. The gap between sleeve 166 and pipe 164 defines an axially extending passage 168 disposed in surrounding relation to the passage 169 formed on the interior pipe 164. The opposite end of sleeve 166 extends into body 162 and has a roller bearing 170 mounted thereon. A second sleeve 172 forming a part of the rotary body 162 and has a central hub 174 which rotatably engages the end of pipe 164. From pipe 164 sleeve 172 extends outwardly and toward body 160 and has a race 176 adjacent its end for engaging the roller bearing 170. The gap 177 between sleeve 172 and pipe 164 defines a co-axial passage which communicates with passage 168.

A third sleeve 178 which forms a part of body 160 is mounted co-axially on sleeve 166 and a fourth sleeve 180 also forming a part of body 160 is mounted co-axially on sleeve 178 and is spaced therefrom to define an axially extending passage 182. A fifth sleeve 184 is affixed co-axially to sleeve 172 and is spaced therefrom to define an axially extending recess 186. The ends of sleeves 178 and 180 abut the ends of sleeves 172 and 184, respectively, to communicate recesses 182 and 186. Sixth and seventh sleeves 188 and 190 are respectively affixed to sleeves 180 and 184 and are spaced therefrom to define axial recesses 192 and 194. The ends of sleeves 188 and 190 abut to communicate recesses 192 and 194. Finally, annular members 196 and 198 are affixed in spaced relation to sleeves 188 and 190 and abut each other to define communicating recesses 200 and 202. Suitable seals 203 are disposed between the abutting sleeves of the bodies 160 and 162 to provide a rotating seal therebetween. Also, ball bearing assembly 204 is disposed between the annular members 196 and 198 to facilitate rotary motion therebetween along with roller bearings 170.

As seen in FIG. 5, pipes 206, 208, 210 and 212 are respectively connected to members 168, 180, 188 and 196 and open into recesses 168, 182, 192 and 200. Also connected to members 172, 184, 190 and 198 are pipes 214, 216, 218 and 220 which also communicate with recesses 177, 186, 194 and 202. From the body 164 the pipes 214, 216, 218 and 220 converge for extending through the recess 224 in trunnion pin 16. In this manner, process fluid sources connected to pipes 206, 208, 210 and 212 can be conducted to vessel 10.

I claim:

1. A metallurgical vessel having a plurality of tuyeres extending therethrough, a trunnion support coupled to said vessel and a plurality of trunnion pin means extending from said support for being rotated to tilt the vesssel about a generally horizontal axis, one of said trunnion pin means having an axial opening formed therein, rotary joint means including first and second portions, the first portion of said rotary joint means including a plurality of concentric, annular members spaced apart radially from each other and affixed to said one trunnion pin means for rotation therewith, the gaps between said plurality of members defining a plurality of axially extending and radially spaced apart flow passages, the second portion of said rotary joint means including means for closing said plurality of flow passages and being in a relative rotary sealed relation to said first portion, a first plurality of passageway means formed in said first rotary portion means and extending at an angle relative to said tilt axis, each of said first plurality of passageway means being connected to a different one of the passages of flow passages, a first plurality of pipe means, each pipe means of said first plurality being connected to a different one of said first plurality of passageway means and extending toward said trunnion pin means, said pipe means converging toward said tilt axis for passing individually through the axial opening in said trunnion pin means, at least some of said first plurality of pipe means being connected to said tuyere means, a second plurality of passageway means formed in said second rotary joint portion and each being in communication with a different one of said first plurality of flow passages, a second plurality of pipe means, each pipe means of said second plurality being connected to a different one of said passageway means, whereby each of said second plurality of passageways may be connected to a different source of process fluid for said vessel.

2. The combinations set forth in claim 1 wherein each of said annular members is generally tubular and has a radially extending flange spaced from that of the adjacent member to define a gap therebetween, and means for closing the outer peripheries of said gaps to define said first plurality of passageway means between said flanges, said first plurality of pipe means extending through said flanges for respectively intersecting one of said gaps.

3. The combination set forth in claims 1 or 2 wherein said plurality of members includes at least three members to define a first flow passage within the interior of the central one of said members and two additional flow passages between said three members, first and second ones of said flow passages being connected by their associated pipes to first and second groups of said tuyeres respectively for delivering a hydrocarbon shielding fluid in separate flow paths to each, the third one of said flow paths being connected to said first group of tuyeres for delivering a fuel thereto.

4. The combination set forth in claim 1 or 2 wherein said plurality of members includes at least five members to define a first flow passage within the interior of the central one of said members and four additional flow passages between said five members, first and second ones of said flow passages being connected by their associated pipes to first and second groups of said tuyeres respectively for delivering a hydrocarbon shielding fluid in separate flow paths to each, a third one of said flow passages being connected to said first group of tuyeres for delivering a fuel thereto, and the fourth and fifth ones of said flow passages being connected by separate pipes for transporting cooling water to and from said trunnion support.

5. A refractory lined metallurgical vessel having a trunnion support and a plurality of trunnion pin means extending from said support for being rotated to tilt the vessel about a generally horizontal axis, a plurality of tuyere means extending through the lining of said vessel and each including a pair of concentric spaced apart pipes for simultaneously providing plural fluids to said vessel, rotary joint means including first and second portions, the first portion of said rotary joint means including a first plurality of concentric, generally annular members spaced apart radially from each other and affixed to one of said trunnion pin means for rotation therewith, said one trunnion pin having an axially extending opening, said first plurality of members defining a first plurality of axially extending and radially spaced apart flow passages, the second portion of said rotary joint means including a second plurality of concentric, generally annular members which are spaced apart radially from each other, at least some of said second plurality of members being coradial with corresponding ones of said first plurality of members to define a second plurality of axially extending and concentric flow passages which have the same radial displacement as corresponding ones of said first plurality of flow passages, said first and second rotary joint portions being disposed in an abutting relation whereby at least some of said first plurality of flow passages communicate with corresponding ones of said second plurality of flow passages, a first and a second plurality of passageway means formed respectively in the first and second portions of said rotary joint means and extending at an angle relative to said tilt axis, each passageway means of said first plurality of passageway means being connected to a different one of the passages of said first plurality of flow passages, a first plurality of pipe means, each of said pipe means of said first plurality of pipe means being connected to a different one of said first passageway means and extending toward said one trunnion pin means, said pipe means converging toward said axis of rotation for passing through the axial opening in said one trunnion pin means, each passageway means of said second plurality of passageway means being connected to a different one of the flow passages of said second plurality of flow passages, a second plurality of pipe means, each of the pipe means of said second plurality of pipe means being connected to a different passageway means of said second plurality of passageway means, whereby each of said second plurality of passageways may be connected to a different source of process fluid for said vessel.

6. The combination set forth in claim 5 and including bearing means for coupling said first rotary joint portion to said second rotary joint portion.

7. The combinations set forth in claim 6 wherein each of said first and second plurality of said generally annular members has a radially extending flange spaced from that of the adjacent member to define a gap therebetween, and means for closing the outer peripheries of said gaps whereby said first and second plurality of passageways are defined between said flanges, said first and second plurality of pipe means extending through said flanges for respectively intersecting its associated one of said gaps.

8. The combination set forth in any of claims 5–7 wherein there are at least three members in each of said first and second pluralities of members to define a first flow passage within the interior of the central ones of said members and two additional flow passages between the other two members of each plurality, a first and second one of said flow passages being connected by their associated pipes to first and second groups of said tuyeres respectively for delivering a hydrocarbon shielding fluid in separate flow paths to each, the third one of said flow paths being connected to said first group of tuyeres for delivering a fuel thereto.

9. The combination set forth in any of claims 5–7 wherein each of said first and second pluralities of members includes at least five members to define a first flow passage within the interior of the central ones of said members and four additional flow passages between said five members, first and second ones of said flow passages being connected by their associated pipes to first and second groups of said tuyeres respectively for delivering a hydrocarbon shielding fluid in separate flow paths to each, a third one of said flow passages being connected to said first group of tuyeres for delivering a fuel thereto, and the fourth and fifth ones of said flow passages being connected by separate pipes for transporting cooling water to and from said trunnion support.

10. A metallurgical vessel having a plurality of tuyeres extending therethrough, a trunnion support coupled to said vessel and a plurality of trunnion pin means extending from said support for being rotated to tilt the vessel about a generally horizontal axis, one of said trunnion pin means having an axial opening formed therein, rotary joint means including first and second portions, the first portion of said rotary joint means including a first plurality of concentric, annular members spaced apart radially from each other and affixed to said one trunnion pin means for rotation therewith, the gaps between said first plurality of members defining a first plurality of axially extending and radially spaced apart flow passages, the second portion of said rotary joint means including a second plurality of concentric, annular members which are spaced apart radially from each other, at least some of said second plurality of members being coradial with corresponding ones of said first plurality of members to define a second plurality of axially extending and concentric flow passages which have the same radial displacement as corresponding ones of said first plurality of flow passages, said first and second rotary joint portions being disposed in an abutting relation whereby at least some of said first plurality of flow passages communicate with corresponding ones of said second plurality of flow passages, a first and second plurality of passageway means formed respectively in the first and second portions of said rotary joint means and each passageway means being connected to a different one respectively of said first and second plurality of flow passages, a first plurality of pipe means, each pipe means of said first plurality of pipe means being connected to a different passageway means of said first plurality of passageway means and extending to said vessel, and a second plurality of pipe means, each of the pipe means of said second plurality being connected to a different one of said second plurality of passageway means, whereby each of said second plurality of passageways may be connected to a different source of process fluid for said vessel.

11. The combination set forth in claim 10 wherein there are at least three members in each of said first and second pluralities of members to define a first flow passage within the interior of the central ones of said members and two additional flow passages between said three members of each plurality, a first and second one of said flow passages being connected to their associated pipes to first and second groups of said tuyeres respectively for delivering a hydrocarbon shielding fluid in separate flow paths to each, the third one of said flow paths being connected to said first group of tuyeres for delivering a fuel thereto.

12. The combination set forth in claim 10 wherein there are at least five members in each of said first and second pluralities of members to define a first flow passage within the interior of the central ones of said members and four additional flow passages between said five members of each plurality, first and second ones of said flow passages being connected by their associated pipes to first and second groups of said tuyeres respectively for delivering a hydrocarbon shielding fluid in separate flow paths to each, a third one of said flow passages being connected to said first group of tuyeres for delivering a fuel thereto, and the fourth and fifth ones of said flow passages being connected by separate pipes for transporting cooling water to and from said trunnion support.

* * * * *